US008322532B2

(12) United States Patent
Schafer et al.

(10) Patent No.: US 8,322,532 B2
(45) Date of Patent: Dec. 4, 2012

(54) PACKAGING DEVICE AND PACKAGING SYSTEM FOR ESSENTIALLY FLAT OBJECTS, FOR EXAMPLE LITHIUM-ION CELLS

(76) Inventors: Tim Schafer, Niedersachswerfen (DE); Andreas Gutsch, Ludinghausen (DE); Gunter Eichinger, Altenstadt (DE); Claus-Rupert Hohenthanner, Hanau (DE); Christian Junker, Dresden (DE); Magnus Mickel, Wittichenau (DE); Heike Schone, Elstra (DE)

( * ) Notice: Subject to any disclaimer, the term of this patent is extended or adjusted under 35 U.S.C. 154(b) by 75 days.

(21) Appl. No.: 12/604,559

(22) Filed: Oct. 23, 2009

(65) Prior Publication Data

US 2010/0126891 A1 May 27, 2010

(30) Foreign Application Priority Data

Oct. 23, 2008 (DE) ..... 10 2008 052 985

(51) Int. Cl.
*B65D 85/30* (2006.01)
*B65D 85/00* (2006.01)

(52) U.S. Cl. ..... 206/703; 206/722; 206/454; 206/521

(58) Field of Classification Search ..... 206/521, 206/703, 722, 454, 449, 523, 586, 583, 453, 206/451, 522, 588–590
See application file for complete search history.

(56) References Cited

U.S. PATENT DOCUMENTS 3,344,973 A * 10/1967 Studen ..... 206/523
3,603,107 A * 9/1971 Elliott et al. ..... 62/459
4,241,829 A 12/1980 Hardy
4,253,892 A 3/1981 D'Angelo et al.
4,376,558 A * 3/1983 Bandar ..... 312/259
(Continued)

FOREIGN PATENT DOCUMENTS

AU B1723383 A 2/1984
(Continued)

OTHER PUBLICATIONS

European Search Report EP09012720 published Apr. 19, 2010.
(Continued)

*Primary Examiner* — Steven A. Reynolds
(74) *Attorney, Agent, or Firm* — Choate, Hall & Stewart LLP

(57) ABSTRACT

Packaging device (10, 10', 10") for packaging at least one object (12, 12', 12"), that is essentially flat, in particular a valuable technical object, such as a lithium-ion cell, including: a bottom plate (14) having at least one first side rim (42), which is linear in regard to at least a part thereof, and at least one first cover plate (20) having at least one first side rim (46) which is linear in regard to at least one part thereof, which is hingeably linked to the first side rim (42) of the bottom plate (14) such that the cover plate (20) can be hinged between a closed position in which the cover plate at least partially covers the bottom plate, and an open position in which the cover plate is not opposite to the bottom plate, characterized in that the bottom plate (14) or the at least one cover plate (20) comprises on one side a cushioning layer (16, respectively 22), wherein the cushioned side faces the object (12, 12', 12") when said object is in the packaging and the at least one cover plate (20) is in the closed position, and wherein the cushioning layer (16, respectively 22) is formed so that the object (12, 12', 12") is held in a no-slip position in respect to lateral shifting, when the at least one cover plate (20) is in the closed position and at least a partial area of the object (12, 12', 12") is positioned between the cover plate (20) and the bottom plate (14).

19 Claims, 7 Drawing Sheets

U.S. PATENT DOCUMENTS

Figure 1A:
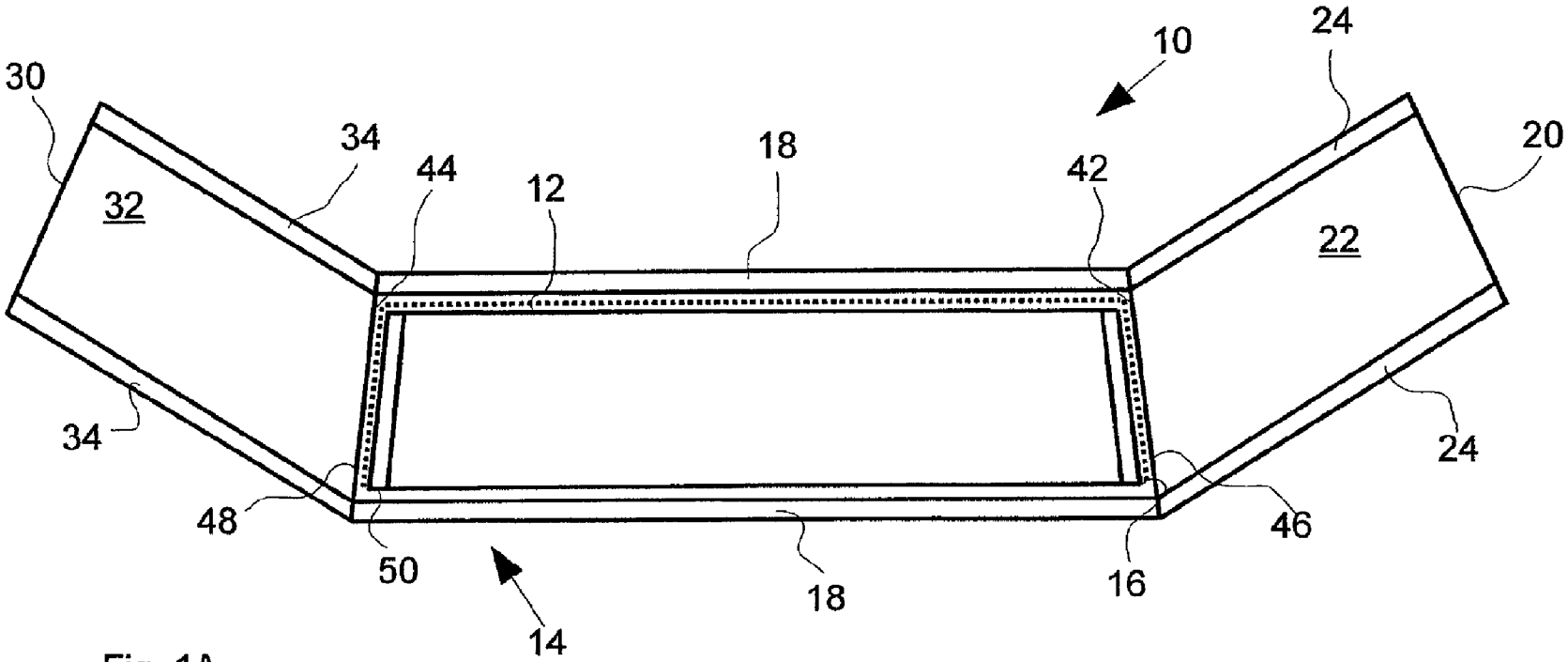

| | | | | |
|---|---|---|---|---|
| 4,609,104 | A * | 9/1986 | Kasper et al. | 206/524.2 |
| 4,664,994 | A | 5/1987 | Koike et al. | |
| 4,773,534 | A * | 9/1988 | DeHeras et al. | 206/709 |
| 4,865,197 | A * | 9/1989 | Craig | 206/709 |
| 5,295,297 | A * | 3/1994 | Kitamura et al. | 29/827 |
| 5,644,212 | A | 7/1997 | Takahashi | |
| 5,739,671 | A | 4/1998 | Hamada | |
| 5,819,942 | A * | 10/1998 | Sadow | 206/522 |
| 5,871,861 | A | 2/1999 | Hirokou et al. | |
| 6,305,539 | B1 * | 10/2001 | Sanders, Jr. | 206/320 |
| 6,391,491 | B1 | 5/2002 | Kim | |
| 6,779,666 | B2 * | 8/2004 | Collins | 206/594 |
| 6,901,971 | B2 * | 6/2005 | Speasl et al. | 141/1 |
| 6,969,548 | B1 * | 11/2005 | Goldfine | 428/159 |
| 7,935,410 | B2 * | 5/2011 | Orologio | 428/178 |
| 2003/0215702 | A1 | 11/2003 | Tanjou et al. | |
| 2003/0224246 | A1 | 12/2003 | Watanabe et al. | |
| 2004/0257042 | A1 | 12/2004 | Liu et al. | |
| 2005/0051447 | A1 * | 3/2005 | Nakajo et al. | 206/455 |
| 2006/0073383 | A1 | 4/2006 | Han et al. | |
| 2006/0134515 | A1 | 6/2006 | Kumashiro et al. | |
| 2006/0137175 | A1 | 6/2006 | Hayashi et al. | |
| 2007/0055951 | A1 | 3/2007 | Hayashi et al. | |
| 2007/0095711 | A1 | 5/2007 | Thompson et al. | |
| 2007/0278130 | A1 * | 12/2007 | Tschantz | 206/594 |
| 2008/0245676 | A1 * | 10/2008 | McManus et al. | 206/7 |
| 2008/0274394 | A1 | 11/2008 | Schormann | |
| 2010/0159306 | A1 | 6/2010 | Leuthner | |
| 2010/0236968 | A1 * | 9/2010 | De Jesus | 206/523 |

FOREIGN PATENT DOCUMENTS

| | | | |
|---|---|---|---|
| AU | 556049 | B2 | 10/1986 |
| DE | 19541959 | A1 | 5/1996 |
| DE | 10202807 | A1 | 8/2003 |
| DE | 102005042916 | A1 | 3/2007 |
| DE | 102007002444 | A1 | 7/2008 |
| EP | 0570590 | A1 | 11/1993 |
| EP | 586232 | A2 | 3/1994 |
| EP | 0862230 | A2 | 9/1998 |
| EP | 0949699 | A2 | 10/1999 |
| EP | 1020943 | A1 | 7/2000 |
| EP | 1079450 | A1 | 2/2001 |
| EP | 1085592 | A2 | 3/2001 |
| EP | 1146579 | A2 | 10/2001 |
| EP | 1976043 | A1 | 10/2008 |
| EP | 1981100 | A1 | 10/2008 |
| JP | 59146166 | A | 8/1984 |
| JP | 2000328159 | A | 11/2000 |
| JP | 2002266041 | A | 9/2002 |
| JP | 2003257418 | A | 9/2003 |
| JP | 2005071784 | A | 3/2005 |
| JP | 2006066083 | A | 3/2006 |
| WO | WO-03015192 | A2 | 2/2003 |
| WO | WO-2005042374 | A1 | 5/2005 |
| WO | WO-2005122294 | A1 | 12/2005 |
| WO | WO-2008004161 | A2 | 1/2008 |

OTHER PUBLICATIONS

European Search Report EP09013438 published Jul. 1, 2010.
European Search Report for EP 09008936 published Oct. 14, 2009.
European Search Report for EP09012719 published Mar. 5, 2010.
European Search Report for EP09012719 published May 19, 2010.
European Search Report for EP09013438 published Feb. 16, 2010.
European Search Report for EP09013439 published Dec. 12, 2009.
European Search Report for EP09013439 published Feb. 16, 2010.
European Search Report for EP09014759 published Jan. 25, 2010.
International Search Report for PCT/EP2008/010035 published Mar. 11, 2009.
Technical data sheet: PE Polyethylene, Jan. 7, 2010, Merk & Partner GMBH, XP002562200.
Technical data sheet: Pet Polyethylenterephtalate, Jan. 7, 2010, Merk & Partner GMBH, XP002562120.
Technical data sheet: PP Polpropylene, Jan. 7, 2010, Merk & Partner GMBH, XP002562121.

* cited by examiner

PACKAGING DEVICE AND PACKAGING SYSTEM FOR ESSENTIALLY FLAT OBJECTS, FOR EXAMPLE LITHIUM-ION CELLS

The present invention relates to a packaging device and a packaging system for essentially flat objects, in particular for valuable objects and objects, which deserve to be protected, such as lithium-ion cells.

For the packaging of a technical object, at first, said object in general is traditionally packaged within a plastic foil, respectively a plastic bag, respectively is encased, and is such protected against dust and humidity. Then, such packaged, respectively encased object is surrounded by a bedding, which, in general, is formed from polystyrene or pressure-formed papier mâché, and is packaged with, respectively is packaged in the encasing bedding in a covering box. The bedding serves for the stable positioning of the technical object within the covering box. As regularly formed additional packaging, generally a rectangular additional packaging, the packaging box serves for the side-by-side stacking and for the one-upon-the-other stacking, and serves as transport protection. In the packaging system comprising plastic foil, respectively plastic bag, bedding and covering box, the bedding may be alternatively replaced by a packaging filling material, such as paper board chips, or plastic chips. A problem with this traditional packaging is that in general it is treated as a one-way packaging, and is disposed after a singular use. A further problem is the plurality of the different used materials, which, after use, have to be given into the trash recycling circulation separated according to material type. If they are stored after the use for another use, i.e., normally after the transport of the technical object, the relatively large outer volume of the packaging, which is larger than the volume of the object to be packaged therein, is a further problem.

For the bedding and the transport of objects such as technical devices, which are repeatedly used in high piece numbers, respectively are re-used in high piece numbers, respectively are constructed in high piece numbers at fixed production sites, which e.g. applies to lithium-ion cells, in general multiple packagings, so-called trays, are used. These multiple packagings, in particular trays, are re-useable and can receive a plurality of similar objects. For this, the multiple packagings may have clamps, respectively depositing forms, which are adjusted to the form of the object to be received. In general, said multiple packagings disadvantageously need as a dust protection and for an easier handling, respectively for an easy stackability, a regularly formed additional packaging, e.g. a rectangular additional packaging.

In view of the problems and drawbacks of the known packagings and packaging systems, it is an object to provide a variable multiple packaging systems for product families of essentially flat objects, such as a lithium-ion cell, which can be technically automatedly filled and can be discharged.

As described in detail in the following, a foldable packaging device is provided for the solution of the object, which comprises a cushion layer and which is developed such to protect an object, which is packaged within said packaging device, from shifting, i.e. said object is in a stable position.

As claimed, a packaging device is provided for packaging at least one essentially flat object, in particular for packaging a valuable technical object such as a lithium-ion cell. Herein, the term "packaging" defines also a receiving, respectively an encasing of the object. In particular, the flat object may be packaged in a horizontal position within the packaging device, respectively can be positioned in such a manner.

The packaging device comprises a bottom plate comprising at least a first side rim, which is linear in regard to at least one part thereof, and at least one first cover plate having at least one first side rim, which is linear in regard to at least one part thereof, which is hingeably linked to the first rim of the bottom plate. Therefore, the cover plate can be hinged between a closed position in which the cover plate at least partially covers the bottom plate, and an opened position in which the cover plate is not opposite to the bottom plate.

According to the invention, the bottom plate, respectively the at least one cover plate, comprises on one side a cushioning layer. Thereby, the cushioned side faces the object when said object is in the packaging, and the at least one cover plate is in the closed position. Furthermore, the cushioning layer is formed so that the object is held in a no-slip position in respect to a lateral shifting when the at least one cover plate is in the closed position, and at least a partial area of the object is positioned between the cover plate and the bottom plate.

Preferably, the bottom plate is formed so that the object can be safely deposited thereon. For example, the bottom plate is provided with a cushioning, respectively is developed with respect to its dimension (length and width) in a larger manner than the dimensions (length and width) of the object to be packaged. This formation of the bottom plate allows a technically automatedly depositing of the object into the packaging device. The formation of the packaging device comprising an essentially flat bottom plate, and the cover plate, which in particular is hingeably linked as a single piece thereto, allows in cooperation with the essentially flat object to be packaged therein, an overall flat design of the packaging device, a good stackability, wherein nearly no loss volumes, respectively clearance volumes are formed, and thus an efficient space yield during stacking for the storage, respectively transportation of a plurality of packaging devices is achieved.

The bottom plate and the first, respectively second cover plate as well as the cushioning layers, which are provided thereon, are in particular essentially developed in a flat manner. Preferably, the bottom plate and the first, respectively second cover plate are elastically flexible so that after a deformation due to bending, they resiliently return into there original, essentially flat form.

Preferably, the cover plate is linked as a single piece to the bottom plate, in particular by means of a fold. The cushioning layer may be integrated within the bottom plate, respectively within the at least one cover plate, or can be fixedly connected thereto. In this manner, the packaging device comprising the mentioned components is, as a whole, in the form of a single piece, in other words: the packaging device has no loose pieces. Therefore, the packaging device as such is complete, and can be used without problems several times, respectively can be used as a re-usable packaging.

By means of the hingable linkage of the cover plate to the bottom plate, an object that is positioned on the bottom plate within the packaging device, can at least be partially received between the bottom plate and the cover plate, and may be encased by the bottom plate and the cover plate when the cover plate is in the closed position: this allows a good protection, in particular a full protection for the packaged object.

Due to the overall flat design of the packaging device in a sandwich construction, i.e. bottom plate—flat object—cover plate, the packaging device is particularly suitable for applications in which the bottom plate is essentially positioned in a horizontal position when the packaging device is charged with the technical object, respectively is supported, in particular when the packaging device is supported in a vertical arrangement of stackings of a plurality of packaging devices.

For a safe, respectively fully protecting packaging of the object, it suffices that the cover plate in the closed position covers the bottom plate only partially, i.e. in a partial area, wherein the object finds place within this partial area. However, preferably, the cover plate nearly totally covers the bottom plate such that in essential the whole area of the bottom plate is available for the depositing of one or several objects to be packaged.

In one embodiment, the packaging device can have a second upper cover plate having a first side rim, which is linear in regard to at least a part thereof, wherein the first side rim of the second cover plate is hingeably linked to one second side rim of the bottom plate, which is linear in regard to at least a part thereof, and which faces the first side rim of the bottom plate, so that the second cover plate can be hinged between a closed position in which the cover plate at least partially covers the bottom plate, and an opened position in which the cover plate is not opposite to the bottom plate. Preferably, the second cover plate has a cushioning layer at one side, wherein the cushioned side faces the object when the object is in the packaging and the second cover plate is in the closed position. As also applies to the first cover plate, the object is held in a no-slip position in respect to a lateral shifting when the second cover plate is in the closed position and at least the partial area of the object is positioned between the cover plate and the bottom plate of the packaging device.

Inter alia, it is possible with the second cover plate that two essentially flat technical objects are packaged independently from each other within the packaging device, wherein the one object is held at least in one partial area of the object in a no-slip position between the bottom plate and the first cover plate, and the second object is held in at least one partial area in a no-slip position between the bottom plate and the second cover plate.

With the second cover plate, which is additionally provided to the first cover plate, on the one hand, it is also possible to receive a relatively large technical object between the bottom plate, and, on the other hand, between the first and the second cover plate, and to position them in a no-slip position. For this, preferably, the first cover plate and the second cover plate are developed such that they together in essential completely cover an object, which is received in the packaging, and in particular together nearly completely cover the bottom plate when the first and the second cover plate are in their closed position, respectively.

For the formation of a clamping that is in a no-slip position with regard to a lateral shifting, the object may be received in the packaging in a clamping position between the cushioning layer, which is positioned on a cover plate, and the cushioning layer, which is positioned on the bottom plate. The at least one cover plate, respectively the bottom plate can be flexible, in particular resilient, respectively elastically flexible. Therefore, during positioning the object between the bottom plate and the cover plate, when the at least one cover plate is in its closed position, a pressure force can be generated effecting the clamping by means of the elastic reset force of the plate, respectively the plates.

For the improvement of the slip resistance, a cushioning layer, in particular a respective cushioning layer, on the bottom plate, respectively on the at least one cover plate, can have an anti-slip coating, which is positioned on one side. Thereby, the coated side faces the object when the object is received within the packaging, and the at least one cover plate is in the closed position. A rubber-like material can form the anti-slip coating. It may also be formed by means of targetedly roughening of the cushioning layer, respectively by applying a coating that increases the adhesion. In particular, the anti-slip coating can have an adhesive coating for the detachable fixing of the object when said object is in at least one partial area in contact with the layer.

The clamping, which is in a no-slip position with regard to the lateral shifting, may also be achieved thereby that a pocket for receiving is formed on the cushioning layer of the bottom plate and/or on the cushioning layer of the at least one cover plate, in particular for the easy inserting and taking of the object. The pocket may be closed on two sides, which are opposite to each other. At a third side, which connects the opposing side, the pocket may also be closed or, alternatively, a hinged breech block may be positioned there. At a fourth, open side, which also connects the two closed sides, preferably, a hinged breech block is formed. When the object is inserted into the pocket, said object is fixed by said pocket with regard to a lateral shifting, in particular with regard to a shifting in direction to the closed sides of the pocket and, if necessary, in direction to the sides of the pocket, which are closed by means of the hinged breech block.

The first cover plate, if necessary a second cover plate, and the bottom plate can have at least one recess that is developed at least one side rim of the respective plate, respectively. Preferably, the at least one recess in the bottom plate is essentially congruent with respect to a respective recess in the first, respectively second cover plate when the first, respectively second cover plate is in its closed position. At least one recess in the bottom plate can be developed at one corner of the bottom plate. The bottom plate can also comprise two recesses that are developed at corners, which are diagonally opposing each other. Congruently to the one, respectively to the several recesses in the bottom plate, the first, respectively second cover plate can comprise respectively positioned recesses. The recesses serve for the purpose that a horizontally positioned packaging device, in particular when positioned between lateral walls, may easily be taken up and lifted by means of the engagement of a tool, respectively by means of the engagement of the fingers of a hand of a user.

The cushioning layer may be developed from a soft material, which is integrally formed at the bottom plate, respectively at the cover plate, or is applied on the bottom plate, respectively the cover plate. In particular, a cushioning layer, in particular a respective cushioning layer, may be developed as air cushion foil layer. Therefore, the object is resiliently received during placing on the cushioned bottom plate, and is received without scratching risk, and is protectively received within the packaging device against external mechanical impacts.

The at least one cover plate can be connected as a single piece to the bottom plate by means of a fold, respectively folds, and may be hingeably linked in this manner. If a single fold is provided, and if the at least one cover plate is brought into the closed position, wherein between the cover plate and the bottom plate the object to be packaged is inserted, then the object presses itself into the cushioning layer on the bottom plate and/or the cushioning layer of the cover plate by means of its finite thickness, and is fixed in this manner. A respective fold preferably is developed such that the cover plate may be hinged from the closed position into an opened position with regard to the bottom plate by an angle of at least 90 degrees, preferably 135 degrees, and still more preferred at least 180 degrees.

Alternatively to the one fold, the at least one cover plate can be connected as a single piece to the bottom plate by means of two folds that are positioned in a predetermined distance. Thereby, in particular the distance of the two folds can be selected such that it corresponds to the height of the packaging with an accuracy that essentially corresponds to the thickness of the bottom plate, respectively the cover plate, when the cover plate is in its closed position.

In particular, each of the two folds can be developed such that the cover plate can be hingeably opened with respect to the bottom plate by an angle of at least 54 degrees, preferably 60 degrees and still more preferred at least 90 degrees, when the cover plate is hinged from its closed position into an opened position with regard to the bottom plate. When the cover plate is in its closed position, the area between the two folds can form a lateral wall of the packaging device. By means of formation of two folds, the packaging device for the packaging, respectively receiving, can also be adapted to a relatively thick object, in particular without thereby subjecting the bottom plate and/or the at least one cover plate to a strong bending.

The packaging device can be developed such that, when a respective cover plate is in its closed position, an encased clearance, which is developed between the respective cover plate and the bottom plate, respectively an object, which is received therein, is thermally isolated and/or electrically isolated with regard to a surrounding of the packaging. In particular, the bottom plate, respectively the at least one cover plate, can have a reflective metal layer for the thermal isolation. In particular, the metal layer can be electrically isolatedly positioned from the side of the cushioning layer, which faces the object when the object is received in the packaging, and the at least one cover plate is in the closed position. For electrical isolation, the cushioning layer itself may be developed from an electrically isolating layer, in particular a plastic layer. Alternatively or additionally thereto, additional to the cushioning layer, an electrically isolating layer can be integrated in the packaging device such that the electrically isolating layer completely encases an object that is deposited into the packaging device when the at least one cover layer, respectively the cover layers, are in their closed position.

The packaging device may additionally have an RFID transponder comprising a storage device connected thereto. The storage device can be developed such that data comprising information such as for example logistical, technical, respectively material-economic information, can be saved or can be saved therein. Logistical information can e.g. comprise the object's place of manufacture and date of manufacture, the object's place of delivery and address of delivery, and technical information concerning the object such as classification, type number, serial number, respectively test number, technical data and the like. Material-economic information can e.g. comprise the piece number of the objects, which are packaged in the packaging device, an order date, packaging date, respectively a delivery date. The saving of such information within the storage device can preferably be effected during the automatedly charging of the packaging device. Via the RFID transponder, which can work as receiver, respectively sender, information may be received from an external sender, respectively may be sent to an external receiving device, and thus a data exchange, respectively information exchange, in particular also a be-directional data exchange, respectively information exchange, may occur. Thus, a memory contents of the storage device may be actualized when, for example, a first object, respectively another object, is received in the packaging device, or when an object is taken from the packaging device when the packaging device passes a spatial barrier, for example a factory gate, respectively a gate of a storage facility, respectively a delivery entrance. By means of the RFID transponder and the storage device connected thereto, the material-economic material flow from the manufacture up to the delivery, respectively use, along a material flow chain may be automatedly monitored, and in particular may also be controlled.

The packaging device can also have a shock sensor for detecting a mechanical impact, respectively an acceleration acting on the packaging. In particular, the shock sensor, or a signal-analyzing device, which is operatively connected thereto, can detect that the acceleration is greater than a predetermined acceleration threshold. The packaging device can also have a temperature sensor, a humidity sensor and/or a sensor for measuring an electrical, respectively magnetic field. By means of monitoring the measuring signals that are generated by said sensors (shock sensor, temperature sensor, etc.), it can be controlled, respectively evidenced whether or not during a certain interval, for example during a transport, a high stress for the packaged object has occurred in the interior of the packaging device, for example by means of a mechanical shock, a high temperature, a high humidity, a high electrical or magnetic field.

The RFID transponder comprising the storage device, respectively the shock sensor, respectively a respective other sensor mentioned before can be positioned with, in particular can be positioned together with, for example adjacent to an object that is received between a cover plate and the bottom plate, in particular in a no-slip position when the cover plate is in its closed position. Alternatively or additionally thereto, the RFID trans-ponder comprising the storage device, respectively shock sensor, respectively temperature sensor, respectively a respective other sensor, may be fixed at the bottom plate or a cover plate such that the thickness, respectively height of the packaging at the location where the transponder, respectively the sensor is fixed, is not greater than the thickness of the packaging when the object is received in the packaging between the bottom plate and a cover plate. For example, the RFID transponder comprising the storage device, respectively the shock sensor, respectively the temperature sensor, respectively a respective other sensor, may be positioned in a recess of the cushioning layer and/or in a recess of the bottom plate, respectively the cover plate.

Within the packaging device, dehumidification means such as silica gel can be provided. The dehumidification means can be provided at a side of at least one cushioning layer, wherein the cushioned layer faces the object when the object is in the packaging, and the at least one cover plate is in the closed position. In particular, the dehumidification means can be provided at a side of the cushioning layer, which is developed as humidity-permeable pocket, or in the form of particles, which are applied on the surface of the side of the cushioning layer. The dehumidification means absorbs/absorb humidity, and such dries/dry the atmosphere within the space in which the object is received within the packaging device when the at least one cover plate in the closed position.

According to another aspect of the invention, a packaging system as claimed is provided for receiving and for safe transporting a plurality of essentially flat objects, in particular valuable technical objects such as lithium-ion cells. The packaging system comprises at least one packaging device as described above, and a receiving device for receiving a plurality of packaging devices as described above. The receiving device is developed such that a respective packaging device is deposited in the receiving device and/or can be taken from said device. Preferably, within the packaging system, the plurality of packaging devices is positioned in parallel towards each other. By means of such a packaging system, a plurality of packaging devices can be supported, respectively transported by avoiding larger loss spaces, respectively clearances, that is can be supported, respectively transported with a more effective space yield.

In one embodiment of the packaging system, the receiving device is at its top face an essentially open and essentially lockable box. The box is developed such that a respective packaging device may be deposited in the box through the open top face of the box, and can be taken from the box, respectively that a plurality of packaging devices can be stacked within the box.

In another embodiment of the packaging system, the receiving device is an inserting device that is at one side essentially open and in particular lockable, which is developed such that a respective packaging device can be inserted into the inserting device through the open side, for example in essential in horizontal orientation and in horizontal direction, and can be taken from said device, and that within the inserting device a plurality of packaging devices is positioned one upon the other, in particular shiftable on inserting guide rails.

Figure 1B:
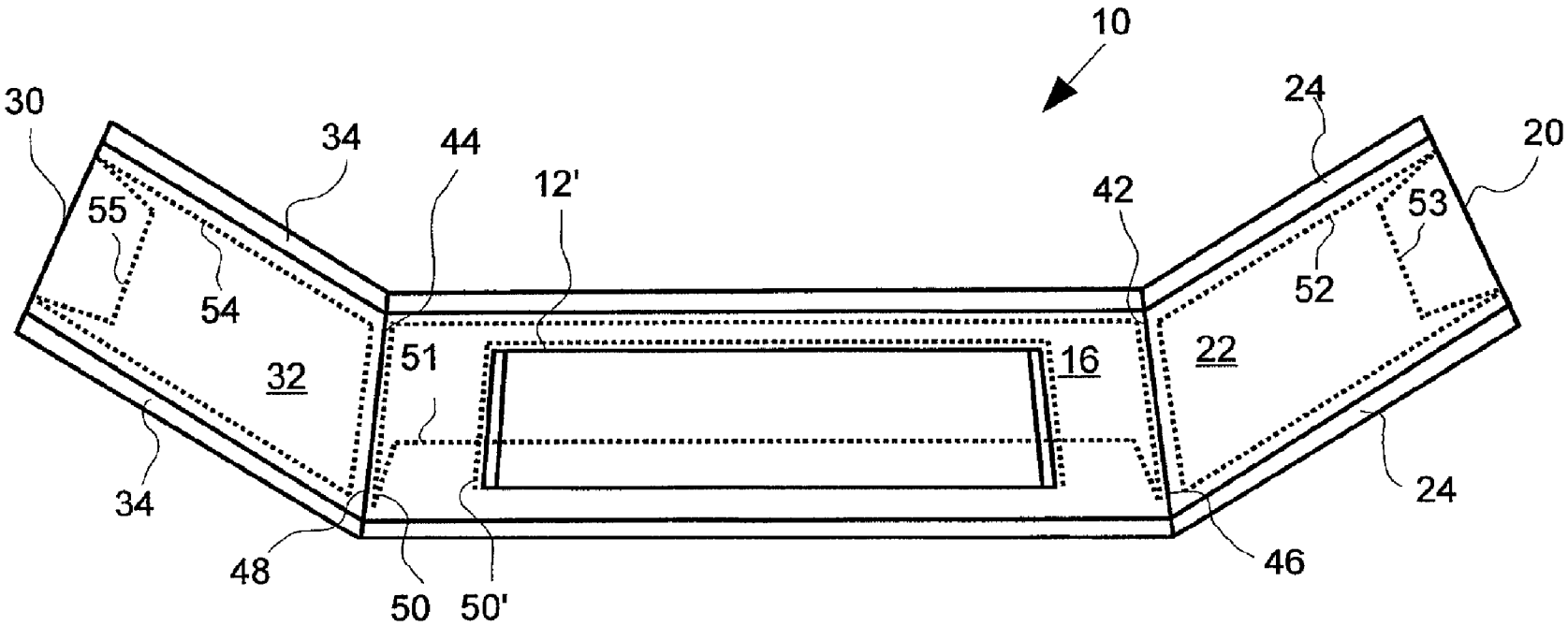
Figure 1C:
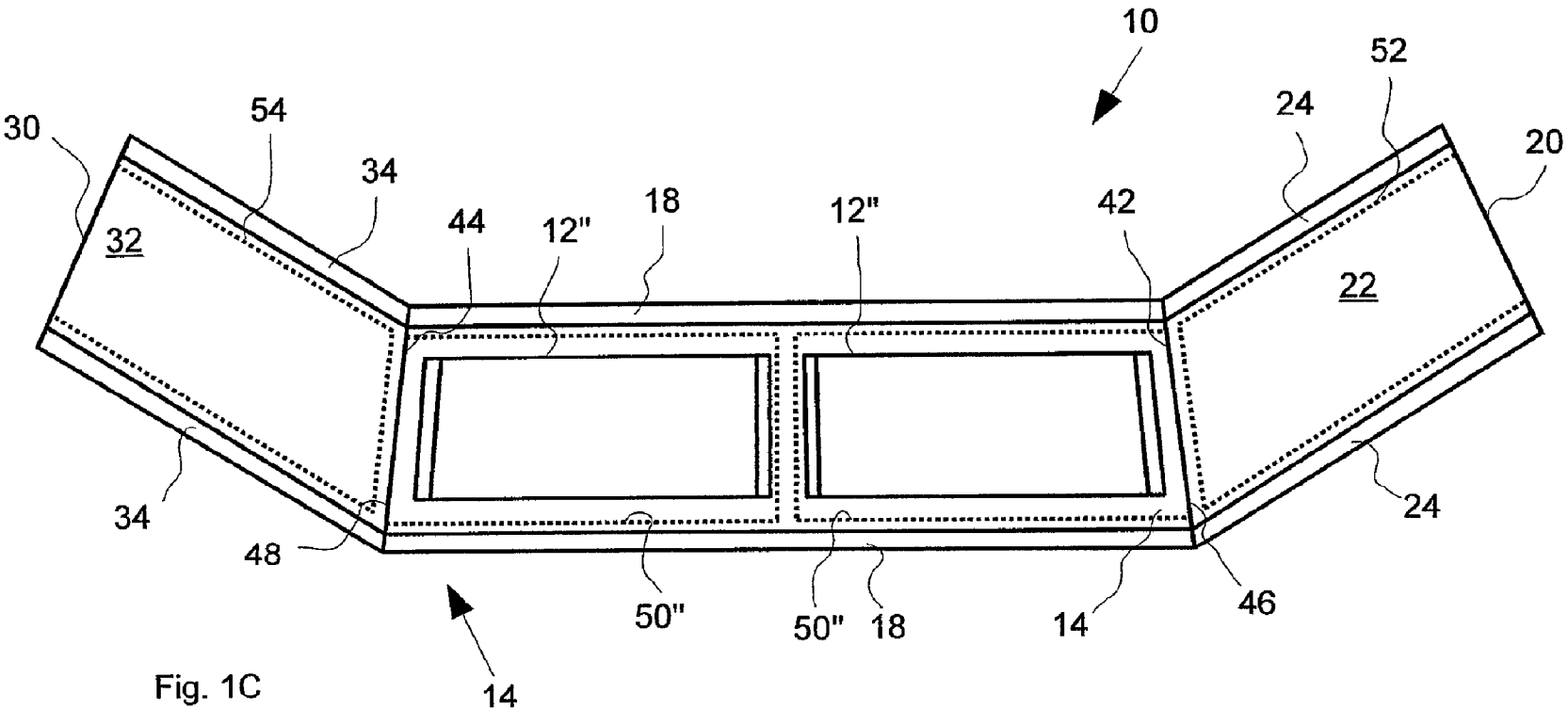
Figure 2:
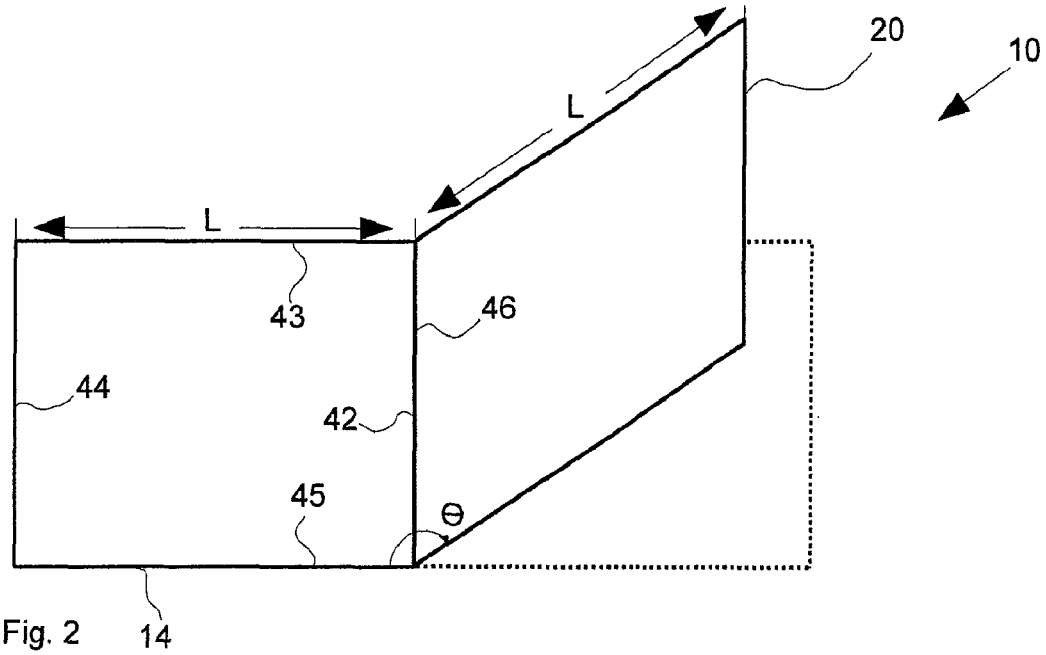
Figure 3:
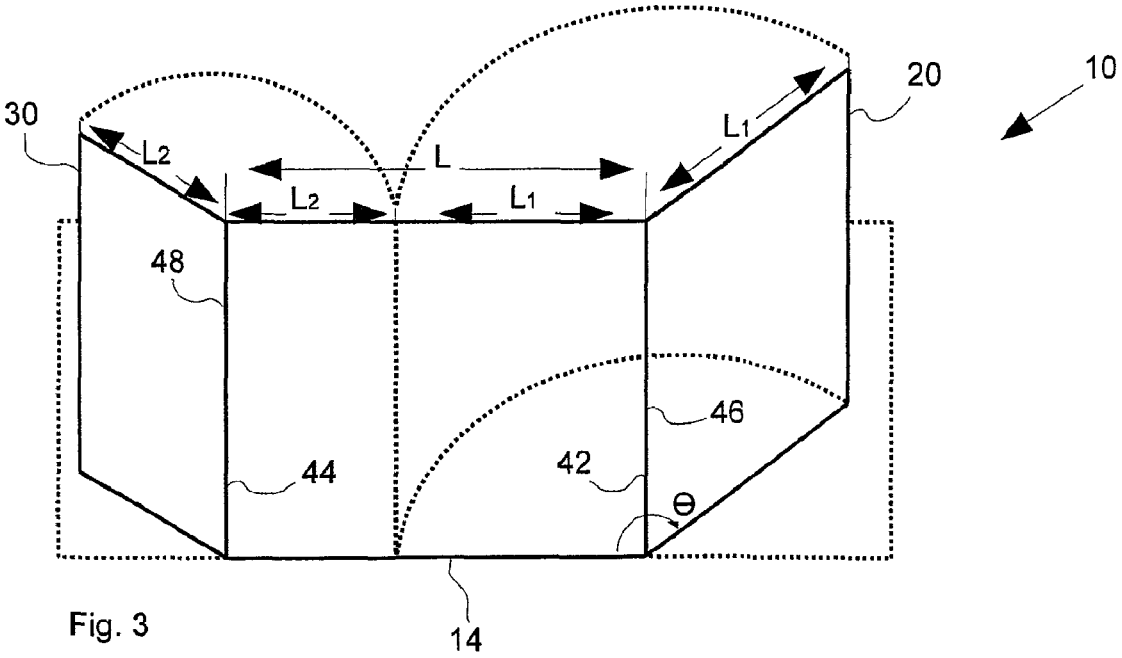
Figure 4:
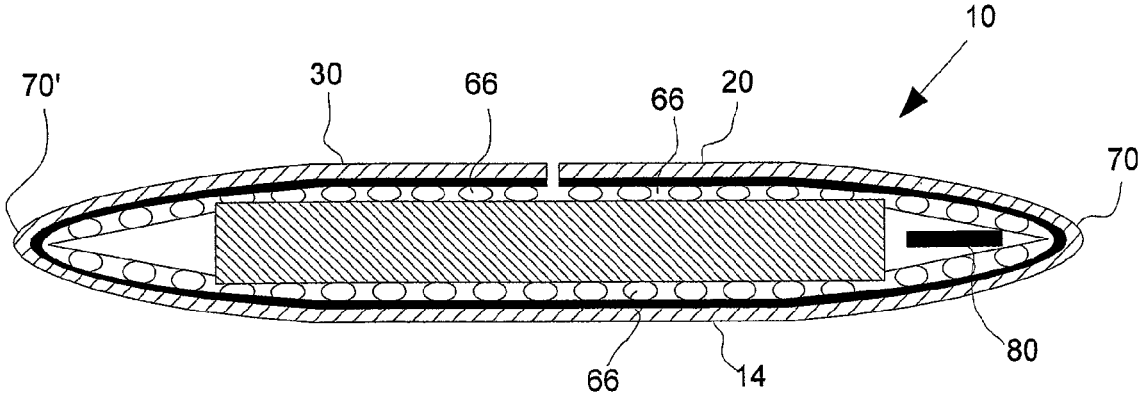
Figure 5:
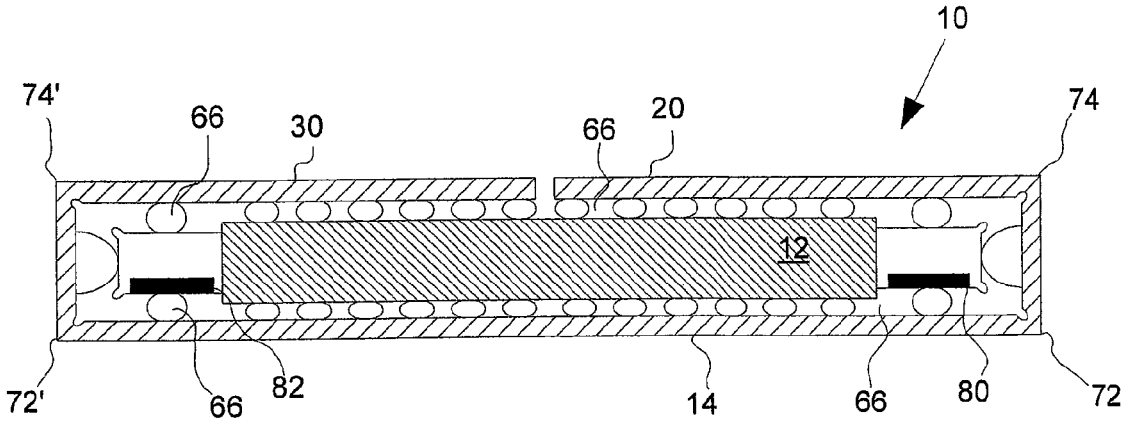
Figure 6A:
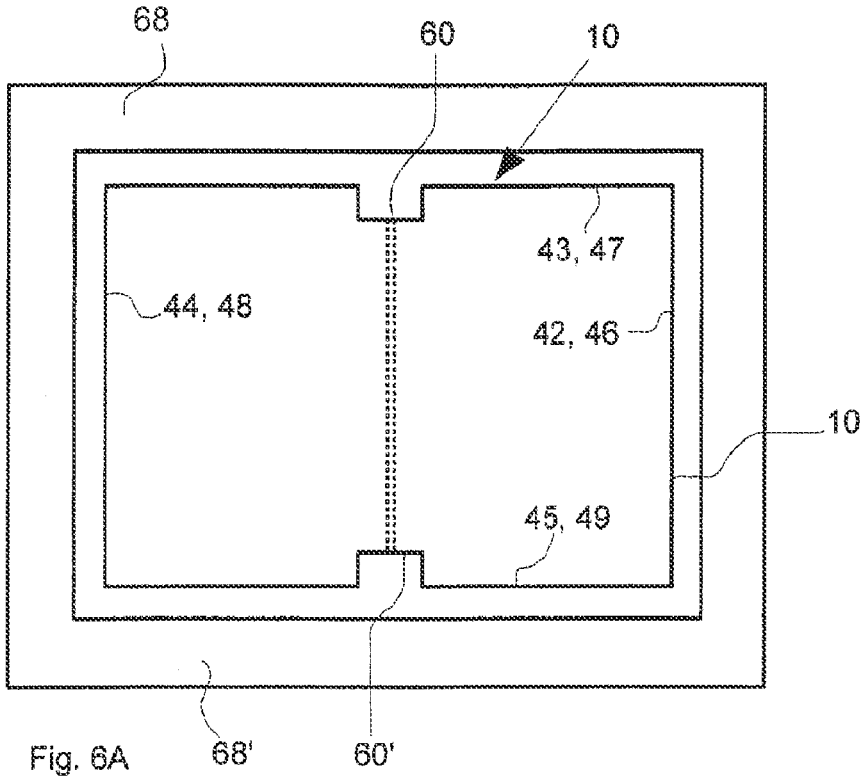
Figure 6B:
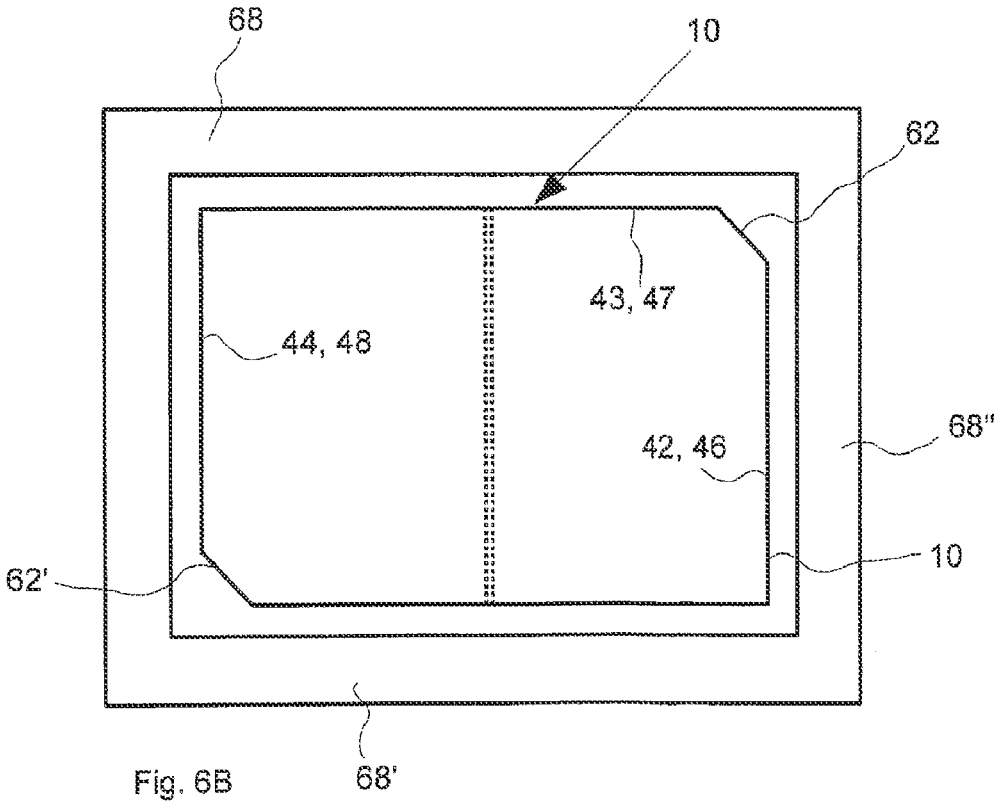
Figure 7A:
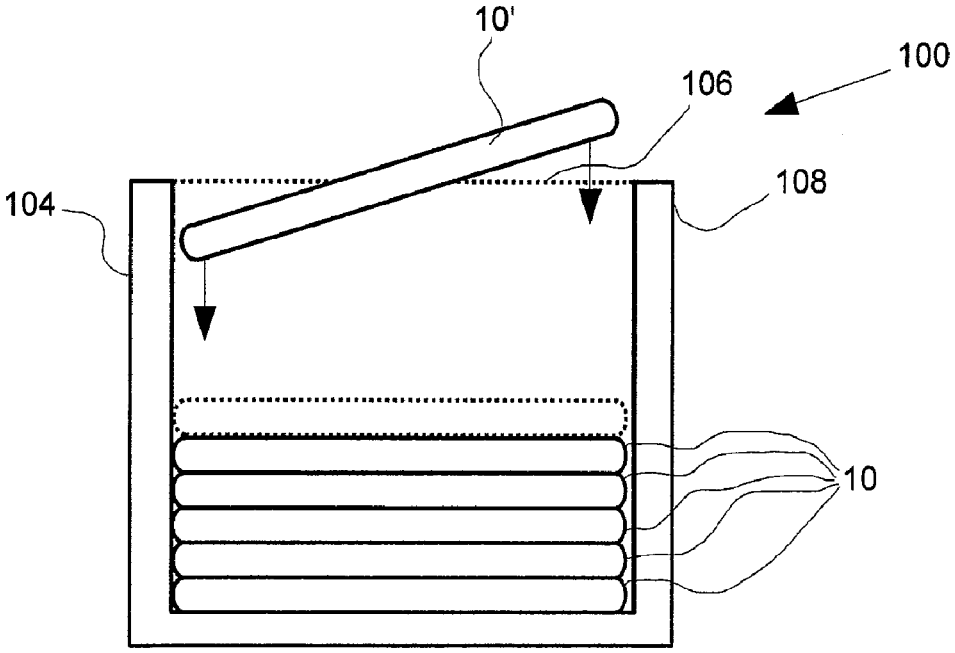
Figure 7B:
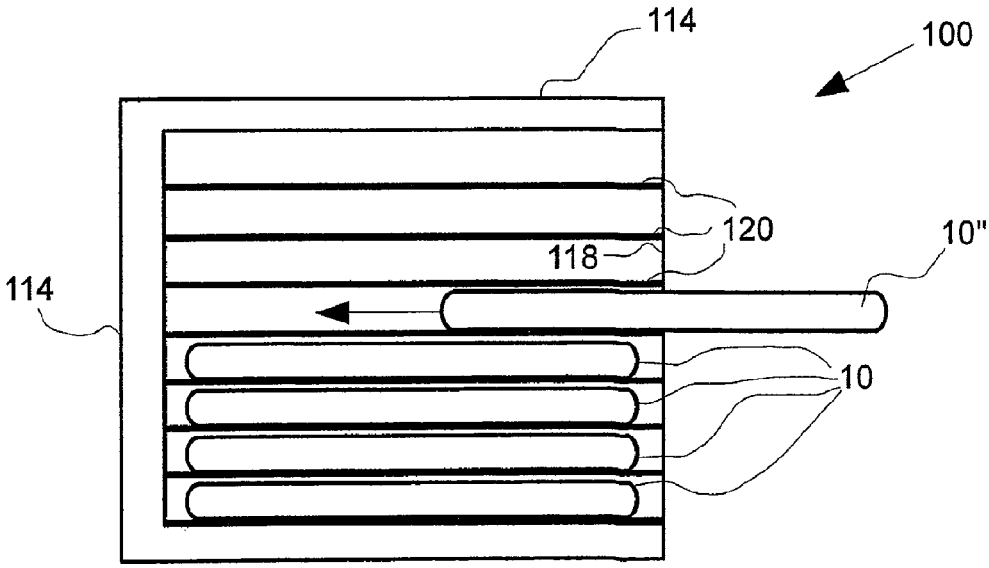

In the following, the present invention is exemplarily described at hand of certain embodiments, which are non-limiting, with reference to the attached drawings. In the drawings show:

FIGS. 1A, 1B and 1C perspective views of a packaging device according to the invention comprising different objects, which are deposited on the bottom plate, and two cover plates, in partially opened position;

FIG. 2 a packaging device according to the invention comprising a single cover plate;

FIG. 3 a packaging device according to the invention comprising tow cover plates;

FIG. 4 a cross-section through a closed packaging device according to the invention comprising a deposited object, wherein a respective cover plate is linked with a fold to the bottom plate;

FIG. 5 a cross-section through a closed packaging device according to the invention comprising an object, which is deposited in the packaging device, wherein a respective cover plate is linked with two folds to the bottom plate;

FIG. 6A and FIG. 6B a top view onto a packaging device according to the invention, which is positioned between side walls for stabilizing a stack of packaging devices, and which has recesses, which are developed at least one side rim; and FIG. 7A and FIG. 7B cross-sections of a packaging system in a first and a second embodiment.

The FIGS. 1A, 1B and 1C show perspective views of an embodiment of a packaging device 10 according to the invention comprising respective different, deposited, essentially flat objects 12, 12' and 12" to be packaged. The packaging device 10 comprises a rectangular bottom plate 14 having a first side rim 42 and a second side rim 44 that are opposite to the first side rim 42, a first cover plate 20 having a first side rim 46 and a second cover plate 30 having a first side rim 48. The first cover plate 20 is hingeably linked to the first side rim 42 of the bottom plate 14 along its first side rim 46 by means of a fold, and is connected as a single piece to the bottom plate 14. The second cover plate 30 is hingeably linked to the second side rim 44 of the bottom plate along its first side rim 48 by means of a fold, and is connected as a single piece to the bottom plate 14. A cushioning layer extends throughout, respectively extends as a single piece, across the first cover plate 20, the bottom plate 14 and the second cover plate 30. Thus, the cushioning layer comprises three partial areas 22, 16 and 32, which form the cushioning layer 22 of the first cover plate 20, the cushioning layer 16 of the bottom plate 14, and the cushioning layer 32 of the second cover plate 30. The cushioning layer has a length that essentially corresponds to the sum of the partial lengths of the areas of the first cover plate 20, the bottom plate 14 and the second cover plate 30. A width of the cushioning layer is less than the width of the bottom plate 14 and the first and second cover plate 20, 30 such that on both sides of the cushioning layer extending across the first cover plate 20, the cover plate 14 and the second cover plate 30 on the plates a lateral strip 24, respectively 34 is formed, respectively, which is not covered by the cushioning layer.

On a respective lateral strip 24, respectively 34 of a respective cover plate, a locking device is provided by means of which a respective cover plate can be fixed in the closed position and can be re-detached. The locking device is for example a hook-and-loop fastener device, or an adhesive locking device, wherein on the lateral strips 24, respectively 34, of the first, respectively the second cover plate 20, respectively 30, on the lateral strip 18 of the bottom plate the counter piece regarding the locking device is positioned. For a hook-and-loop fastener, on the lateral strip 18 for example the loop-like locking elements, and on the lateral strips 24, respectively 34, the hook-like locking devices are positioned, or vice versa. For an adhesive locking device, on the lateral strips 24, respectively 34, the layer of the adhesion means is provided, and on the lateral strip 18 the correspondingly provided non-adhesive layer is provided, or vice versa.

In FIG. 1A, on the bottom plate 18, a relatively large, essentially flat object 12 is positioned. In FIG. 1B, on bottom plate 14, compared to the object shown in FIG. 1A, a smaller, essentially flat object 12' is deposited. In FIG. 1C, on bottom plate 14, two objects 12" are positioned side by side, wherein a respective cover plate 20, respectively 30 completely covers the respective object 12" in the closed condition.

In the embodiment of the packaging device shown in FIG. 1A, on the bottom plate a pocket for receiving the object is developed, in particular for inserting and taking. As shown in FIG. 1, by means of the dashed line, a pocket 50 is developed by means of three closed sides, and an open side that extends along the lateral strip 18 of bottom plate 14 for charging with the object 12. In FIG. 1B, on bottom plate 14, a pocket 50' is developed for receiving the object 12'. On the bottom plate 14, the pocket 50' can be developed alone, or can be additionally developed to at least one further pocket such as the pocket 50 as shown in FIG. 1B and/or further pockets (not shown).

A respective pocket has two closed lateral strips, which are opposite towards each other, and additionally a third lateral strip, which connects the two closed lateral strips to each other, such as exemplarily shown for pocket 50 in FIG. 1A and pockets 50 and 50' in FIG. 1B. A respective pocket has at an open side a folding flap 51 such as the folding flap 51 of the pocket 50, which additionally may also serve as folding flap for the pocket 50'. A respective folding flap can be hinged into a closing and an opening position. Thereby, in the opened position, the side of a pocket for inserting, respectively taking the object is released. In the locking position, the closed side of the pocket is locked by means of the folding flap, and such a slipping out of an object from the pocket is prevented, which has been inserted into the pocket.

Alternatively thereto or additionally to pockets on the bottom plate, pockets may be provided also on one or on both cover plates, in particular pockets comprising folding flaps. In FIG. 1B, the device 10 has a pocket 52 having a folding flap 53 additionally to pockets 50 and 50' on bottom plate 14 on the first cover plate 20, and on the second cover plate 30 a pocket 54 having a folding flap 55.

As shown in FIGS. 1A, 1B and 1C, the packaging device is suitable for packaging one object having a variable size (as shown in FIGS. 1A and 1B), or two objects (as shown in FIG. 1C), or also three or more objects (not shown), provided the objects can be positioned on the bottom plate 18 side by side.

FIG. 2 shows a perspective view of a packaging device 10 having a bottom plate 14 and a cover plate 20, which is hingeably linked via its first side rim 46 to a side rim 42 of the bottom plate 14.

In FIG. 2, the first cover plate 20 and the bottom plate 14 in essential have the same width, measured along the side rim 42, respectively 46. The length of the cover plate 20, which is indicated in FIG. 2 by the dimensioning "l", preferably is essentially equal to a length of the bottom plate 14, which is indicated in FIG. 2 by the dimensioning "L". However, the length of the cover plate 20 may be shorter than the length of the bottom plate 14 so that, when the cover plate 20 is in the closed position, on the bottom plate 14 a strip-like partial area (not shown) is created that extends along the side rim 44 of the bottom plate, and which is not covered by the cover plate 20. At, respectively on the lateral strip, for example, supporting devices or an engaging device, such as a recess 60, may be provided as shown in FIG. 6A.

FIG. 3 shows a packaging device 10 according to the invention having a bottom plate 14 and two cover plates, that is to say a first cover plate 20 and a second cover plate 30. The first cover plate 20 is hingeably linked along its first side rim 46 to a first side rim 42 of the bottom plate 14. The second cover plate 30 is hingeably linked along its first side rim 48 to the second side rim 44 of the bottom plate 14, which is opposite to the first side rim 42. The first, respectively second cover plate 20, respectively 30, has a width, which is measured along its respective side rim 46, respectively 48, which is essentially equal to the width of the bottom plate, which is measured along the side rim 42, respectively 44 of the bottom plate 14. The first, respectively second cover plate 20, respectively 30, has a length $l_1$, respectively $l_2$ which, taken together, preferably correspond to a total length of the bottom plate 14 so that when the first and second lateral plate 20 and 30 are in their closed position, the bottom plate 14 is in essential completely covered by the cover plates 20 and 30.

When the first and second cover plate 20 and 30 in essential completely cover the bottom plate 14, then also an object 12, respectively 12', which is deposited in the packaging device 10, which protrudes from a partial area that is covered by a single cover plate, as shown in FIGS. 1A and 1B, can be nearly completely encased by the first and second cover plate 20 and 30, when the sum of the lengths $l_1$ and $l_2$ of the first and second cover plate is essentially equal to the length L of the bottom plate 14, as shown in FIG. 3.

The FIGS. 4 and 5 show cross-sections through a packaging device 10 in the closed condition, wherein an object 12 is deposited in the packaging device 10, respectively. In FIG. 4, at the bottom plate 14, the first cover plate 20 is hingeably linked by means of a fold 70, and the second cover plate 30 is hingeably linked by means of a fold 70'. The bottom plate 14 and the first and second cover plate 20 and 30 have an elastic flexibility, respectively. If, for an object that is deposited in the packaging device 10, the first and second cover plate 20 and 30 are brought into their respective closed position, and are flatly pressed, respectively pressed into contact with one side of the object 12, then the first and second cover plate 20, respectively 30 and/or the bottom plate 14 bend in proximity of the rims of the object 12.

For the packaging device 10 shown in FIGS. 4 and 5, the cushioning layer is developed by means of an air cushion layer 66 having a plurality of air cushions, respectively air bubbles. In the area in which the object 12 is deposited between the cover plates and the bottom plate, the cushioning layer is a little bit compressed, whereas the cushioning layer in the area, in which the object 12 does not extend, is in a relaxed condition, or in a condition in which the area of the cushioning layer is less compressed or non-compressed. Thereby that the cushioning layer is compressed in the areas in which the object 12 extends, the object 12 is held in a no-slip position in respect to a lateral shifting relative to the plates 14, 20, respectively 30.

In the embodiment shown in FIG. 5 of a packaging device 10, the first cover plate 20 is hingeably linked to the bottom plate 14 by means of two folds, that is to say a first fold 72 and a second fold 74, and also correspondingly the second cover plate 30 by means of two folds, that is to say a first fold 72' and a second fold 74'. The respective first and second fold 72 and 74, respectively 72' and 74' are positioned in parallel towards each other, and are spaced from each other in a predetermined distance. The distance between the first and second fold 72 and 74, respectively 72' and 74' essentially corresponds, i.e., up to an accuracy corresponding to a thickness of the first, respectively second cover plate 20, respectively 30, to the height of the packaging device 10 when the both cover plates 20 and 30 are in the closed position. The distance between the first and second fold 72 and 74, respectively 72' and 74' is adapted to the thickness of an object 12 to be packaged, and is selected such that the distance is nearly equal or is approximately equal to the sum of the thickness of the bottom plate 14 having cushioning layer, the thickness of the object 12 and the thickness of the first, respectively second cover plate 20, respectively 30 having cushioning layer. The distance between the first and second fold 72 and 74, respectively 72' and 74', however is not less than the sum of the thicknesses of the bottom plate 14 without cushioning layer, the thickness of the object 12 and the thickness of the first, respectively second cover plate 20, respectively 30 without cushioning layer. If the distance between the two folds 72 and 74, respectively 72' and 74' is selected in the before-described interval, it is possible that the cushioning layers of the cover plate and/or the cushioning layer of the bottom plate are resilient and are compressed when an object 12 is deposited between the bottom plate and the cover plates, which are in their respective closed position, and is held in a no-slip position in respect to a lateral shifting by means of the compressing.

The FIGS. 6A and 6B are top views onto a respective packaging device 10 according to the invention, which is positioned, respectively is deposited between lateral walls 68, 68' and 68", if necessary as the top most packing device of a stack of packaging devices. Between the lateral walls 68, 68' and 68", one or a plurality of packaging devices are stacked one upon the other, and are secured against the tumbling down of the stack. As shown in FIG. 6A, in a side rim of the packaging device 10, a recess 60, respectively 60' is developed. The recess 60 is within a side rim 43 of the bottom plate of the packaging device 10, and is congruently developed thereto in a side rim 47 of the cover plate. The recess 60, respectively 60' serves as engagement aid and allows that, for example by means of the fingers of a hand of a user, or by means of a gripper tool, can be engaged between the packaging device 10 and a lateral wall 68, 68', and thus the packaging device can be easily gripped and can be lifted.

As shown in FIG. 6B, the packaging device 10 comprises recesses 62, respectively 62', which are developed at corners that diagonally are opposite to each other. The recesses 62 and 62', which are developed at the corners serve for the same purpose compared to the recesses 60, respectively 60', which are developed in the side rims and which are shown in FIG. 6A.

The FIGS. 7A and 7B are cross-sectional views and show different embodiments of a packaging system 100 for receiving, supporting and transporting one or a plurality of packaging devices 10, 10', 10" according to the invention.

In an embodiment shown in FIG. 7A, the packaging system 100 comprises a receiving device 104 for receiving a plurality of packaging devices 10', wherein the receiving device 104 is developed as a box 108. The box 108 is open at its top face 106. A packaging device 10' can be deposited in the box 108 through the open top face as shown in FIG. 7A by the arrows directed downwards. In the box 108, a plurality of packaging devices 10' can be positioned in a stacked manner one upon the other. The opening at top face 106 of the box 108 can be closed by means of a cover (not shown). The cover may be developed as loose piece or as one or several folding flaps, which are hingeably linked to the box 108.

In the embodiment of FIG. 7B, the packaging system 100 comprises an inserting device 114 having a plurality of inserting guide rails 120 as receiving device for receiving a plurality of packaging devices 10". The inserting device 114 has an open side 118 for the charging of the inserting device with packaging devices 10". The inserting guide rails 120 are provided in pairs, respectively, and are positioned and developed such that a packaging device 10" is supported thereon, respectively is shiftably supported between, in particular can be inserted into the inserting device 114 as indicated in FIG. 7B by means of the arrow that is directed to the left side at the packaging device 10". In the inserting device 114, a plurality of packaging devices 10' can be positioned one upon the other, and may be supported by a pair of inserting guide rails 120, respectively. The open side 118 of the inserting device 114 can be closed, for example by means of one or two linked lateral doors (not shown), or by means of a shiftable device according to the principle of a roller shutter (not shown).

REFERENCE NUMERALS

10, 10', 10" packaging device, respectively packaging
12, 12', 12" object, e.g. lithium-ion cell
14 bottom plate
16 cushioning layer (on bottom plate)
18 lateral strip (on bottom plate)
20 first cover plate
22 cushioning layer (on first bottom plate)
24 lateral strip (on first cover plate)
30 second cover plate
32 cushioning layer (on second cover plate)
34 lateral strip (on second cover plate)
42 first side rim (of bottom plate)
43 third side rim (of bottom plate)
44 second side rim (of bottom plate)
45 fourth side rim (of bottom plate)
46 first side rim (of first cover plate)
47 third side rim (of first cover plate)
48 first side rim (of second cover plate)
49 third side rim (of second cover plate)
50, 50', 50" pocket (on bottom plate)
51 folding flap
52 pocket (on first cover plate)
53 folding flap
54 pocket (on second cover plate)
55 folding flap
60, 60' recess (at side rim)
62, 62' recess (at corner)
66 air cushion layer
68, 68', 68" lateral wall
70 fold (bottom plate—cover plate)
72, 72' first fold (bottom plate—lateral wall)
74, 74' second fold (side wall—cover plate)
80 RFID transponder
82 shock sensor
100 packaging system
104 receiving device
106 top face (for charging the box)
108 box
114 inserting device
118 open side (for charging with packaging devices)
120 inserting guide rail

The invention claimed is:

1. A packaging device for packaging at least one object that is essentially flat, in particular a valuable technical object, such as a lithium ion cell, comprising:

a bottom plate having at least one first side rim, which is linear in regard to at least a part thereof, and at least one first cover plate having at least one first side rim which is linear in regard to at least one part thereof, which is hingeably linked to the first side rim of the bottom plate such that the at least one first cover plate can be hinged between a closed position in which the at least one first cover plate at least partially covers the bottom plate, and an open position in which the at least one first cover plate is not opposite to the bottom plate, wherein the bottom plate comprises a cushioning layer on one side, wherein the cushioned side faces the object when said object is in the packaging and the at least one first cover plate is in the closed position, wherein the cushioning layer is formed such that the object is held in a no-slip position in respect to lateral shifting, when the at least one first cover plate is in the closed position and at least a partial area of the object is positioned between the at least one first cover plate and the bottom plate;

a single pocket to hold the entire flat object therein, in the cushioning layer of the bottom plate, and/or in cushioning layers of the at least one first cover plate, which is adapted for inserting and taking the flat object; and a second cover plate having a first side rim which is linear in regard to at least a part thereof, wherein the first side rim of the second cover plate is hingeably linked to a second side rim of the bottom plate, which is linear in regard to at least a part thereof, and which is opposite to said first side rim of the bottom plate such that the second cover plate can be hinged between a closed position in which the second cover plate at least partially covers the bottom plate and an open position in which the second cover plate is not opposite to the bottom plate, wherein at least one of the first cover plate, the second cover plate, and the bottom plate comprise at least one recess, which is provided along at least one side rim of the respective plate, and wherein the bottom plate comprises at least one recess, the at least one recess in the bottom being essentially congruent to a respective recess in the first cover plate and the second plate, when the first cover plate and the second cover plate are in the closed position.

2. The packaging device according to claim 1, wherein the at least one first cover plate nearly completely covers the bottom plate in its closed position.

3. The packaging device according to claim 1 wherein the second cover plate comprises at one side a cushioning layer, wherein the cushioned side faces the object when the object is in the packaging and the second cover plate is in the closed position, and that the cushioning layer on the second cover plate is developed such that the object is held in a no-slip position in respect to lateral shifting when the second cover plate is in the closed position and at least a partial area of the object is positioned between the second cover plate and the bottom plate.

4. The packaging device according to claim 1 wherein the first cover plate and the second cover plate together essentially completely cover an object which is received within the packaging, when said plates are in their closed position, respectively, and nearly completely cover the bottom plate together.

5. The packaging device according to claim 4, wherein a cushioning layer on at least one cover plate and the bottom plate comprises an anti-slip coating, which is positioned on one side, wherein the coated side faces the object when the object is within the packaging and the at least one cover plate is in the closed position.

6. The packaging device according to claim 5, wherein at least one cushioning layer is provided as an air cushion foil layer.

7. The packaging device according to claim 6, wherein at least one cover plate is connected to the bottom plate as a single piece by means of two folds, which are positioned a predetermined distance apart.

8. The packaging device according to claim 7, wherein when said cover plates are in their closed positions, an object, which is received between the respective cover plates and the bottom plate is in an encased clearance, is thermally isolated and/or is electrically isolated with respect to a surrounding of the packaging.

9. The packaging device according to claim 8, wherein the bottom plate and the at least one cover plate comprise a reflective metal layer for thermal isolation, and the metal layer is electrically isolated with respect to the side of the cushioning layer, which faces the object when the object is received within the packaging and the at least one cover plate is in the closed position.

10. A packaging device according to claim 9, wherein the packaging device comprises an RFID transponder comprising a storage device, which is in operative connection with the same.

11. The packaging device according to claim 10, wherein the packaging device comprises a shock sensor for detecting a mechanical impact, respectively an acceleration that influences the packaging, which can be greater than a predetermined acceleration threshold.

12. The packaging device according to claim 11, wherein the RFID transponder comprising the storage device and/or the shock sensor is positioned between the bottom plate and a cover plate when the cover plate is in its closed position.

13. The packaging device according to claim 11 the RFID transponder comprising the storage device and/or the shock sensor is fixed at the bottom plate or a cover plate such that the height of the packaging at the location where the RFID transponder and/or the shock sensor is fixed, is not greater than the thickness of the packaging when the object is received in the packaging between the bottom plate and a cover plate.

14. The packaging device according to claim 13, wherein on one side of at least one cushioning layer, a dehumidification means, such as a silica gel, is positioned, wherein the cushioned layer faces the object when the object is in the packaging and the at least one cover plate is in the closed position, wherein the dehumidification means is/are provided in a humidity permeable pocket, which is developed on one side of the cushioning layer, or is provided in the form of particles, which are applied on the surface of the side of the cushioning layer.

15. The packaging system for receiving and safely transporting of a plurality of essentially flat objects, in particular valuable technical objects such as lithium-ion cells, comprising:

at least one packaging device and a receiving device for receiving a plurality of packaging devices according to claim 14, and developed such that a respective packaging device can be deposited in the receiving device and can be taken from said receiving device.

16. The packaging device according to claim 1, wherein at least one cover plate is connected as a single piece to the bottom plate by means of a fold.

17. A packaging device for packaging at least one object that is essentially flat, in particular a valuable technical object, such as a lithium ion cell, comprising:

a bottom plate having at least one first side rim, which is linear in regard to at least a part thereof, and at least one first cover plate having at least one first side rim which is linear in regard to at least one part thereof, which is hingeably linked to the first side rim of the bottom plate such that the at least one first cover plate can be hinged between a closed position in which the at least one first cover plate at least partially covers the bottom plate, and an open position in which the at least one first cover plate is not opposite to the bottom plate, wherein the bottom plate comprises a cushioning layer on one side, wherein the cushioned side faces the object when said object is in the packaging and the at least one first cover plate is in the closed position, wherein the cushioning layer is formed such that the object is held in a no-slip position in respect to lateral shifting, when the at least one first cover plate is in the closed position and at least a partial area of the object is positioned between the at least one first cover plate and the bottom plate;

a single pocket to hold the entire flat object therein, in the cushioning layer of the bottom plate, and/or in cushioning layers of the at least one first cover plate, which is adapted for inserting and taking the flat object; and a second cover plate having a first side rim which is linear in regard to at least a part thereof, wherein the first side rim of the second cover plate is hingeably linked to a second side rim of the bottom plate, which is linear in regard to at least a part thereof, and which is opposite to said first side rim of the bottom plate such that the second cover plate can be hinged between a closed position in which the second cover plate at least partially covers the bottom plate and an open position in which the second cover plate is not opposite to the bottom plate, wherein at least one of the first cover plate, the second cover plate, and the bottom plate comprise at least one recess, which is provided along at least one side rim of the respective plate, and wherein the at least one recess is provided in a corner of the bottom plate, and a second recess is provided in a second corner of the bottom plate, which is opposite to said corner.

18. A packaging system for receiving and safely transporting a plurality of essentially flat objects, the packaging system comprising:

at least one packaging device and a receiving device for receiving a plurality of packaging devices, the plurality of packaging devices developed such that a respective packaging device can be deposited in the receiving device and can be taken from said receiving device, the plurality of packaging devices further comprising:

a bottom plate having at least one first side rim, which is linear in regard to at least a part thereof, and at least one first cover plate having at least one first side rim which is linear in regard to at least one part thereof, which is hingeably linked to the first side rim of the bottom plate such that the at least one first cover plate can be hinged between a closed position in which the at least one first cover plate at least partially covers the bottom plate, and an open position in which the at least one first cover plate is not opposite to the bottom plate, wherein the bottom plate comprises a cushioning layer on one side, wherein the cushioned side faces the object when said object is in the packaging and the at least one first cover plate is in the closed position, wherein the cushioning layer is formed such that the object is held in a no-slip position in respect to lateral shifting, when the at least one first cover plate is in the closed position and at least a partial area of the object is positioned between the at least one first cover plate and the bottom plate, the plurality of packaging devices further comprising a second upper cover plate having a first side rim which is linear in regard to at least a part thereof, wherein the first side rim of the second cover plate is hingeably linked to a second side rim of the bottom plate, which is linear in regard to at least a part thereof, and which is opposite to said first side rim of the bottom plate such that the second cover plate can be hinged between a closed position in which the second cover plate at least partially covers the bottom plate and an open position in which the second cover plate is not opposite to the bottom plate, wherein a cushioning layer on at least one cover plate and the bottom plate comprises an anti-slip coating, which is positioned on one side, wherein the coated side faces the object when the object is within the packaging and the at least one cover plate is in the closed position, wherein at least one cushioning layer is provided as an air cushion foil layer, wherein at least one cover plate is connected to the bottom plate as a single piece by means of two folds, which are positioned a predetermined distance apart, such that when said cover plates are in their closed positions, an object, which is received between the respective cover plates and the bottom plate is in an encased clearance, is thermally isolated and/or is electrically isolated with respect to a surrounding of the packaging, wherein the bottom plate and the at least one cover plate comprise a reflective metal layer for thermal isolation, and the metal layer is electrically isolated with respect to the side of the cushioning layer, which faces the object when the object is received within the packaging and the at least one cover plate is in the closed position, wherein the packaging device comprises an RFID transponder comprising a storage device, which is in operative connection with the same, wherein the packaging device comprises a shock sensor for detecting a mechanical impact, respectively an acceleration that influences the packaging, which can be greater than a predetermined acceleration threshold, the RFID transponder comprising the storage device and/or the shock sensor is fixed at the bottom plate or a cover plate such that the height of the packaging at the location where at least one of the RFID transponder and the shock sensor is fixed, is not greater than the thickness of the packaging when the object is received in the packaging between the bottom plate and a cover plate, on one side of at least one cushioning layer, comprising a dehumidification means, such as a silica gel, is positioned, wherein the cushioned layer faces the object when the object is in the packaging and the at least one cover plate is in the closed position, wherein the dehumidification means is/are provided in a humidity permeable pocket, which is developed on one side of the cushioning layer, or is provided in the form of particles, which are applied on the surface of the side of the cushioning layer, wherein the receiving device is a box, which is essentially open at its top face and is lockable, which is suitable for depositing a respective packaging device through the open top face of the box into the box, and can be taken from said box, and that in the box, a plurality of packaging devices can be stacked.

19. A packaging system for receiving and safely transporting a plurality of essentially flat objects, the packaging system comprising:

at least one packaging device and a receiving device for receiving a plurality of packaging devices, the plurality of packaging devices developed such that a respective packaging device can be deposited in the receiving device and can be taken from said receiving device, the plurality of packaging devices further comprising:

a bottom plate having at least one first side rim, which is linear in regard to at least a part thereof, and at least one first cover plate having at least one first side rim which is linear in regard to at least one part thereof, which is hingeably linked to the first side rim of the bottom plate such that the at least one first cover plate can be hinged between a closed position in which the at least one first cover plate at least partially covers the bottom plate, and an open position in which the at least one first cover plate is not opposite to the bottom plate, wherein the bottom plate comprises a cushioning layer on one side, wherein the cushioned side faces the object when said object is in the packaging and the at least one first cover plate is in the closed position, wherein the cushioning layer is formed such that the object is held in a no-slip position in respect to lateral shifting, when the at least one first cover plate is in the closed position and at least a partial area of the object is positioned between the at least one first cover plate and the bottom plate, the plurality of packaging devices further comprising a second upper cover plate having a first side rim which is linear in regard to at least a part thereof, wherein the first side rim of the second cover plate is hingeably linked to a second side rim of the bottom plate, which is linear in regard to at least a part thereof, and which is opposite to said first side rim of the bottom plate such that the second cover plate can be hinged between a closed position in which the second cover plate at least partially covers the bottom plate and an open position in which the second cover plate is not opposite to the bottom plate, wherein a cushioning layer on at least one cover plate and the bottom plate comprises an anti-slip coating, which is positioned on one side, wherein the coated side faces the object when the object is within the packaging and the at least one cover plate is in the closed position, wherein at least one cushioning layer is provided as an air cushion foil layer, wherein at least one cover plate is connected to the bottom plate as a single piece by means of two folds, which are positioned a predetermined distance apart, such that when said cover plates are in their closed positions, an object, which is received between the respective cover plates and the bottom plate is in an encased clearance, is thermally isolated and/or is electrically isolated with respect to a surrounding of the packaging, wherein the bottom plate and the at least one cover plate comprise a reflective metal layer for thermal isolation, and the metal layer is electrically isolated with respect to the side of the cushioning layer, which faces the object when the object is received within the packaging and the at least one cover plate is in the closed position, wherein the packaging device comprises an RFID transponder comprising a storage device, which is in operative connection with the same, wherein the packaging device comprises a shock sensor for detecting a mechanical impact, respectively an acceleration that influences the packaging, which can be greater than a predetermined acceleration threshold, the RFID transponder comprising the storage device and/or the shock sensor is fixed at the bottom plate or a cover plate such that the height of the packaging at the location where at least one of the RFID transponder and the shock sensor is fixed, is not greater than the thickness of the packaging when the object is received in the packaging between the bottom plate and a cover plate, on one side of at least one cushioning layer, comprising a dehumidification means, such as a silica gel, is positioned, wherein the cushioned layer faces the object when the object is in the packaging and the at least one cover plate is in the closed position, wherein the dehumidification means is/are provided in a humidity permeable pocket, which is developed on one side of the cushioning layer, or is provided in the form of particles, which are applied on the surface of the side of the cushioning layer, wherein the receiving device is an inserting device, which at one side is essentially open and is lockable, which is suitable for inserting a respective packaging device through the open side into the inserting device, for example in essential in horizontal orientation and in horizontal direction, and can be taken from said device, and that in the inserting device a plurality of packaging devices are positioned one upon the other, and in particular can be shiftably supported on inserting guide rails.

* * * * *